US009038884B2

(12) United States Patent
Bernstein

(10) Patent No.: US 9,038,884 B2
(45) Date of Patent: May 26, 2015

(54) CARTON WITH OPENING AND RECLOSING FEATURE

(71) Applicant: Rock-Tenn Shared Services, LLC, Norcross, GA (US)

(72) Inventor: Linda A. Bernstein, Lilburn, GA (US)

(73) Assignee: ROCK-TENN SHARED SERVICES, LLC, Norcross, GA (US)

( * ) Notice: Subject to any disclaimer, the term of this patent is extended or adjusted under 35 U.S.C. 154(b) by 0 days.

(21) Appl. No.: 14/080,167

(22) Filed: Nov. 14, 2013

(65) Prior Publication Data

US 2014/0131429 A1 May 15, 2014

Related U.S. Application Data

(60) Provisional application No. 61/726,164, filed on Nov. 14, 2012.

(51) Int. Cl.

| | |
|---|---|
| ***B65D 5/70*** | (2006.01) |
| ***B65D 5/72*** | (2006.01) |
| *B65D 5/54* | (2006.01) |
| *B65D 5/02* | (2006.01) |

(52) U.S. Cl.

CPC ..... *B65D 5/725* (2013.01); *B65D 5/5435* (2013.01); *B65D 5/0227* (2013.01)

(58) Field of Classification Search

CPC .... B65D 5/5435; B65D 5/725; B65D 17/168; B65D 5/0227

USPC ..... 229/210, 215, 221

See application file for complete search history.

(56) References Cited

U.S. PATENT DOCUMENTS

| | | | | |
|---|---|---|---|---|
| 1,585,494 | A * | 5/1926 | Harvey | 229/221 |
| 2,509,289 | A * | 5/1950 | Dunning | 229/215 |
| 3,133,688 | A * | 5/1964 | Asman | 229/215 |
| 3,203,615 | A | 8/1965 | Moore | |
| 3,203,616 | A | 8/1965 | Bolton et al. | |
| 3,335,933 | A * | 8/1967 | Woodling | 229/122 |
| 3,335,940 | A * | 8/1967 | Dykes | 229/221 |
| 3,356,279 | A * | 12/1967 | Root | 229/221 |
| 3,438,565 | A | 4/1969 | Coe et al. | |
| 3,542,259 | A * | 11/1970 | Marchesani | 229/122 |
| 3,563,447 | A | 2/1971 | Katzenmeyer | |
| 3,853,261 | A | 12/1974 | Moore | |
| 4,138,052 | A * | 2/1979 | Torigian | 229/120.32 |
| 4,356,951 | A * | 11/1982 | Sharp | 229/125.42 |
| 4,809,853 | A | 3/1989 | Weber | |
| 4,944,406 | A | 7/1990 | Zehnal | |
| 5,067,615 | A | 11/1991 | Davitian | |
| 5,114,013 | A | 5/1992 | Brown et al. | |
| 5,326,024 | A | 7/1994 | Fogle | |
| 5,333,781 | A | 8/1994 | Roccaforte | |
| 6,116,502 | A * | 9/2000 | Noseworthy et al. | 229/215 |
| 6,318,626 | B1 | 11/2001 | St. Pierre et al. | |
| 6,688,515 | B1 | 2/2004 | Huffman et al. | |
| 2010/0252619 | A1* | 10/2010 | Harrelson | 229/121 |
| 2012/0118904 | A1 | 5/2012 | Fitzwater et al. | |

FOREIGN PATENT DOCUMENTS

| | | |
|---|---|---|
| WO | 0074931 | 12/2000 |
| WO | 2012103161 | 8/2012 |
| WO | 2012151118 | 11/2012 |

* cited by examiner

*Primary Examiner* — Gary Elkins

(74) *Attorney, Agent, or Firm* — Kilpatrick Townsend & Stockton LLP

(57) ABSTRACT

A seal end carton having a feature that creates an aperture and that may be opened and reclosed. The carton may be constructed from a flat carton blank that is then folded and sealed. The carton further includes an opening and reclosing feature that can be opened and reclosed multiple times.

16 Claims, 7 Drawing Sheets

CARTON WITH OPENING AND RECLOSING FEATURE

CROSS-REFERENCE TO RELATED APPLICATION

This application claims the benefit of U.S. Provisional Application No. 61/726,164 filed Nov. 14, 2012 and titled "Carton with Opening and Reclosing Feature," the contents of which are hereby incorporated by reference.

FIELD

Embodiments of the present invention relate to folding cartons having an opening and reclosing feature.

BACKGROUND

Seal end type folding cartons are used in various industries for a variety of purposes, for example, but not limited to, food storage and dispensing. In some cases it is desirable to have a reclose feature that allows the contents of the seal end folding carton to be easily dispensed while also allowing the carton to be reclosed and its contents secured within the carton. For example, but without limitation, a seal end carton may be used to store and dispense candy, pasta, chewing gum, nuts, bolts, or other food or non-food particulate products.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Some embodiments of the present disclosure provide for a seal end carton having a feature that creates an aperture and that may be opened and reclosed. Embodiments of the invention may be constructed from a flat carton blank that is then folded and sealed. In some embodiments, the blank may be folded and glued into an erected carton, the carton may be filled with a particulate product, and the carton may then be closed and sealed. Embodiments further include an opening and reclosing feature that may be opened and reclosed.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1:
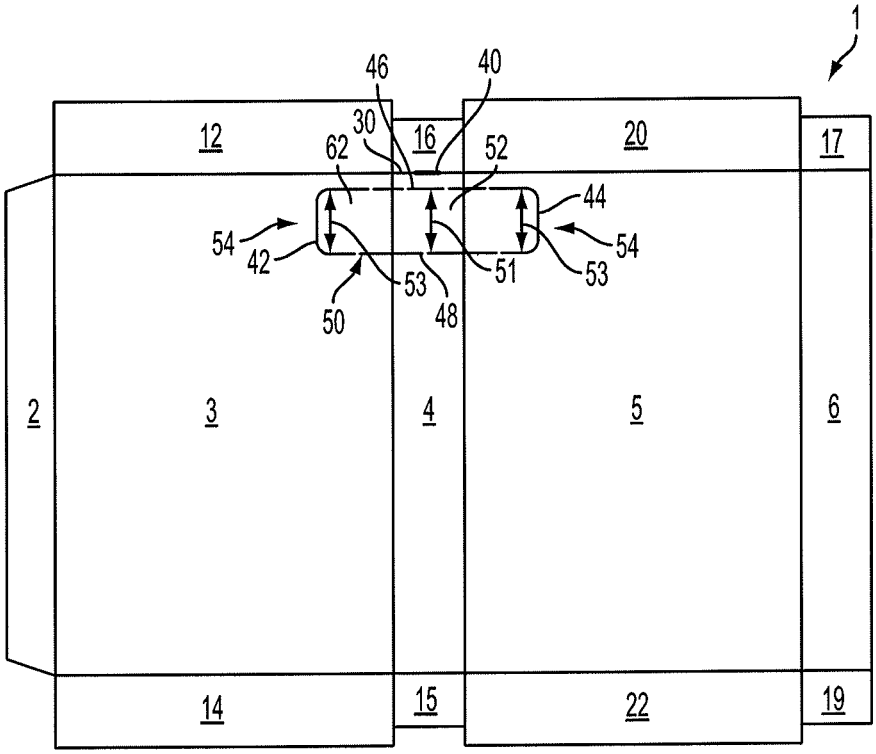
FIG. 1 is a plan view of a unitary blank of foldable material that may be folded and glued to form a carton having an opening and reclosing feature according to one embodiment.

Referring now to the drawings for a better understanding of the invention, FIG. 1 illustrates a single blank of foldable material 1. The blank illustrated herein is formed from foldable substrates, which may be paper-based material such as paperboard or corrugated sheet material, although other materials may be used if desired. The blank may be formed from virgin or recycled material, may be coated or uncoated, and may be single-ply or laminated paperboard.

As illustrated, blank 1 includes five adjacent panels 2, 3, 4, 5, and 6. In some embodiments, panels 2, 3, 4, 5, 6 are generally rectangular in shape, although the panels may have any suitable shape to form an assembled carton having a desired shape. The panels of blank 1 shown in FIG. 1 may be folded to create an assembled carton.

Once erected, panels 12, 16, 17, and 20 serve as top end panels and panels 14, 15, 19, and 22 serve as bottom end panels. In some embodiments, panel 2 is a glue panel and any suitable adhesive may be applied to glue panel 2. Panels 3 and 5 are referred to as side panels, panel 4 is referred to as a front panel, and glue panel 2 overlaps with rear panel 6 to form the rear portion of the assembled carton. Once erected, either the top end panels 12, 16, 20, 17 are sealed or the bottom end panels 14, 15, 22, 19 are sealed, and the carton may be filled with a particulate product. After filled with product, the other of the top or bottom end panels is then sealed.

In some embodiments, blank 1 may be configured as a seal end type carton. As described below, blank 1 may also include an opening and reclosing feature 50. In some embodiments, the addition of the opening and reclosing feature does not require reconfiguring the seal end type carton, but only the addition of various score, perforation and/or cut lines, so a standard seal end type style carton may be used. Because the tab created by the opening and reclosing feature 50 (shown in FIGS. 4 and 6) is integral with the carton, no material is removed from the package.

As shown in FIG. 1, opening and reclosing feature 50 of blank 1 is defined by perforation lines 46, 48 and fold lines 42, 44. Perforation lines 46, 48 may be perforation lines, cut lines, nicks, or other suitable lines of weakness. As shown in FIG. 1, the top of the opening and reclosing feature 50 is created by perforation line 46, which extends upwards slightly from the top of fold line 42 and curves to the right, extending from panel 3 across the width of panel 4 and into panel 5, where it curves down and terminates at fold line 44. The bottom of the opening and reclosing feature 50 is created by perforation line 48, which extends downwardly slightly from the bottom of fold line 42 and curves to the right extending across panel 4 and into panel 5, where perforation line 48 curves upwards and terminates at fold line 44. Once perforation lines 46, 48 are broken, tab 62 is released and may fold around fold lines 42, 44 as described below to create an aperture 60 (shown in FIG. 4).

In the embodiment shown in FIG. 1, perforation line 48 is slightly angled upward as it extends from panel 4 into panel 3 and is slightly angled upward as it extends from panel 4 into panel 5, while remaining substantially horizontal throughout the width of panel 4. This slight angling creates an offset so the opening and reclosing feature has varying heights. Specifically, in the non-limiting embodiment shown in FIG. 1, the angling of perforation line 48 results in a front portion 52 of opening and reclosing feature 50 that has a height 51 and rear portions 54 of opening and reclosing feature 50 that have a height 53, with the front portion 52's height 51 being approximately 1/32 inch taller than height 53 of rear portions 54 in this particular embodiment. In other embodiments, other suitable offsets may be used. Similarly, in other embodiments, the offset (the angle) may vary or have different starting and/or termination points.

When the carton is assembled and the opening and reclosing feature is in the closed position (FIGS. 2, 7), taller front portion 52 of tab 62 of opening and reclosing feature 50 is located closer to the front of the carton, and shorter rear portions 54 of tab 62 are located closer to the rear of the carton.

In other embodiments, perforation line 46 may be angled instead of perforation line 48, or perforation lines 46 and 48 may both be angled to create the desired offset between tab 62's front height 51 and tab 62's rear height 53. Varying the amount of offset determines the ease with which the opening and reclosing feature moves from its open to closed position and how securely the opening and reclosing feature stays in its open position.

In some embodiments, as shown in FIG. 1, blank 1 may include a notch 40 positioned above the opening and reclosing feature 50. When used, notch 40 helps ensure that flap 16 is folded correctly despite the proximity of perforation line 46 to fold line 30. Notch 40 may be a small cut or other suitable feature.

Figure 2:
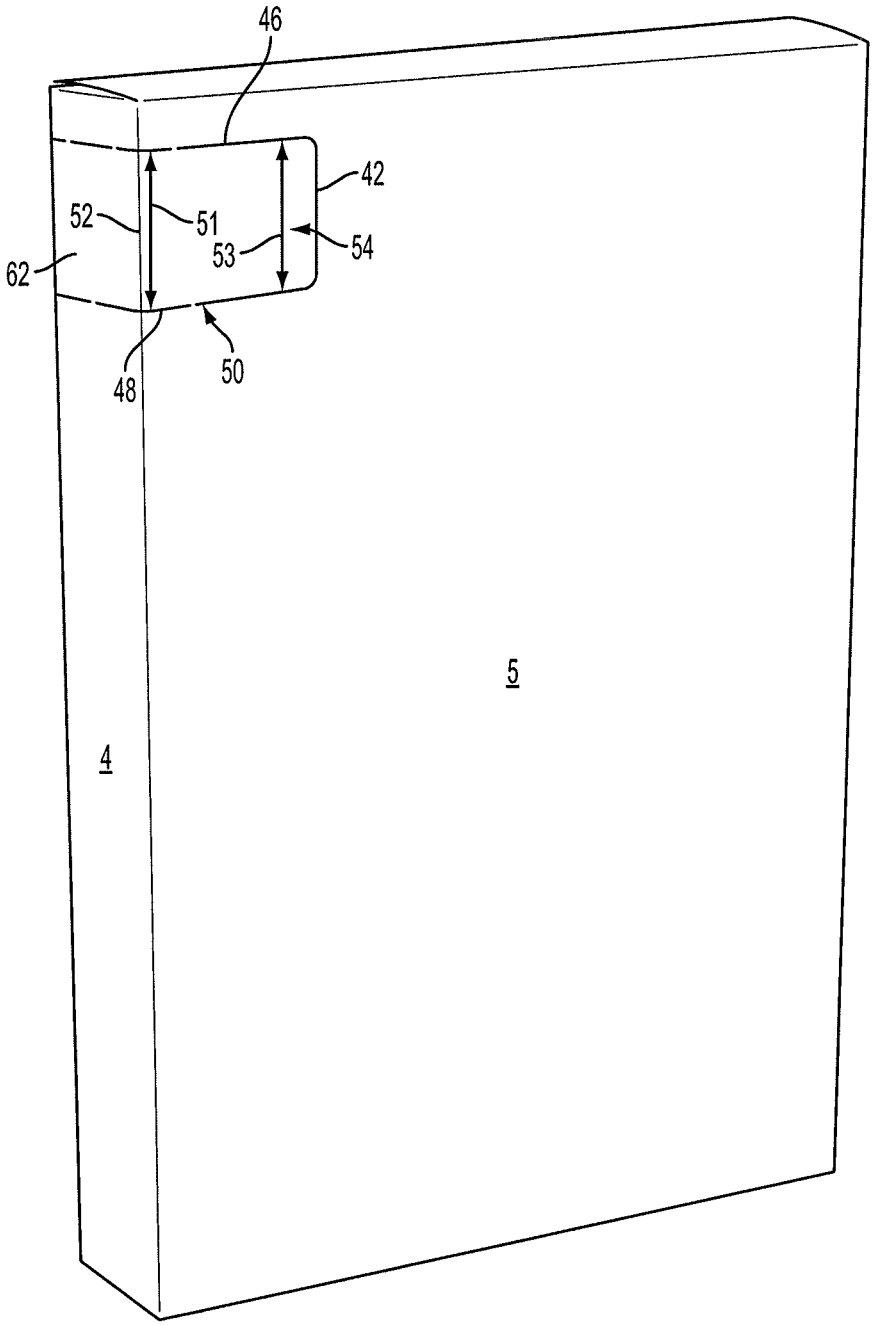
FIG. 2 is a side perspective view of a carton assembled from the blank of FIG. 1.
Figure 4:
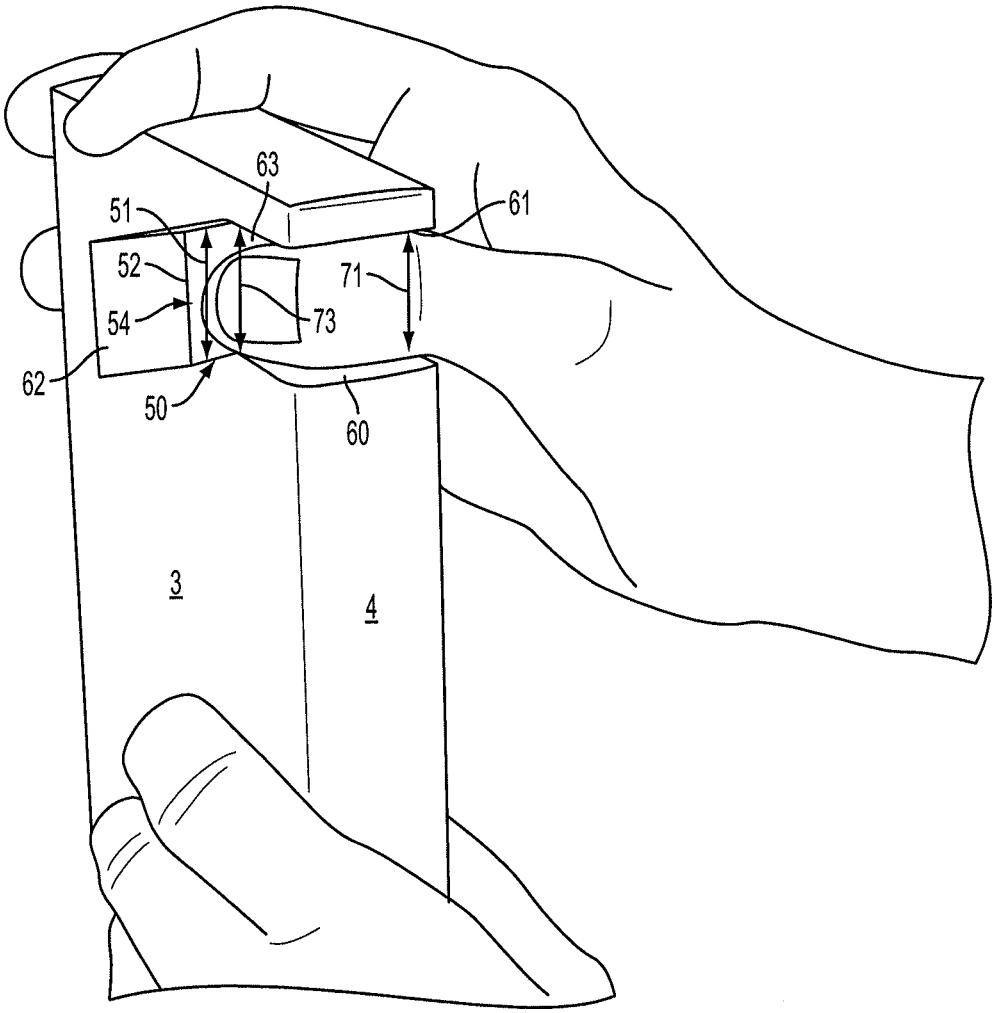
FIG. 4 is a perspective view of the assembled carton of FIG. 2 as the opening and reclosing feature moves to its open position.
Figure 5:
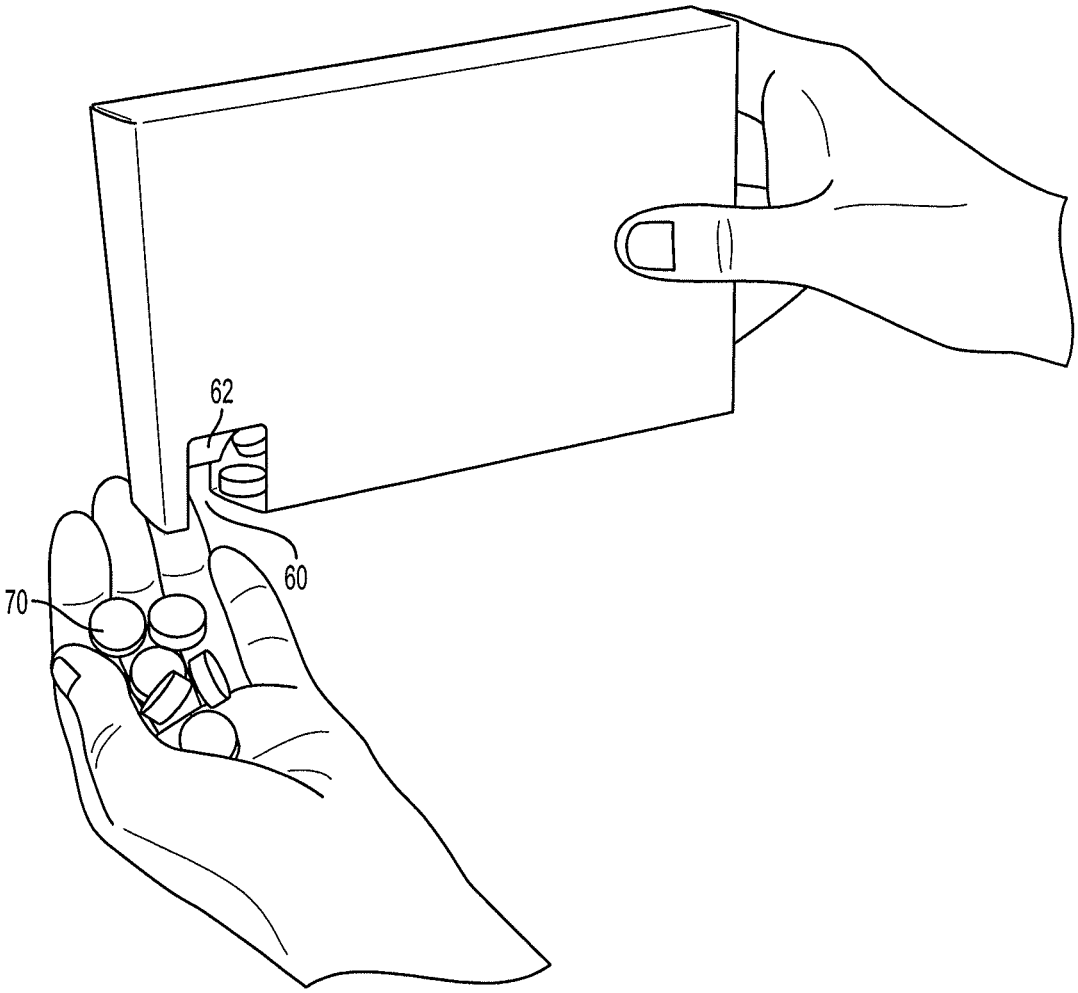
FIG. 5 is a perspective view of the assembled carton of FIG. 2, showing the opening and reclosing feature in the open position and product being dispensed from the carton.

As shown in FIG. 2 and described above, the carton assembled from the blank of FIG. 1 has an opening and reclosing feature 50 that is defined by perforation lines 46, 48 and fold lines 42, 44 (not shown). As shown in FIG. 2, when the carton is assembled, perforation lines 46, 48 wrap from side panel 3 (not shown), across front panel 4 and into side panel 5. As shown in FIG. 2, opening and reclosing feature 50 comprises tab 62 with front portion 52 having height 51 that is taller than tab 62's rear portions 54's height 53, as determined by the angle of perforation line 48. As stated above, in other embodiments, perforation line 46 may be angled (such as angled upward from rear to front) while perforation line 48 may be substantially horizontal, such that the front portion 52 is taller than rear portion 54 of tab 62, or in yet other embodiments, both perforation lines 46, 48 could be angled to create the desired offset between the height of front portion 52 and rear portions 54. Once perforation lines 46, 48 are broken, tab 62 may be folded around fold lines 42, 44 (not shown) to move tab 62 between its closed position (FIGS. 2, 7) and its open position (FIGS. 4-5). When tab 62 moves from its closed position toward its open position, aperture 60 (not shown) of opening and reclosing feature 50 is exposed. The smaller height 53 towards rear portions 54 of aperture 60 (shown in FIG. 4) aids in retaining tab 62 in its open position by way of friction, as described in more detail below.

While FIG. 2 shows opening and reclosing feature 50 located near the top of the carton, opening and reclosing feature 50 may be located at other locations on the carton, such as toward the middle of the carton as long as the product remains beneath the level of opening and reclosing feature 50. In addition, the width and/or height of opening and reclosing feature 50 may vary from what is shown in FIG. 2. For example, the width and/or the height of opening and reclosing feature 50 may be increased to allow for the dispensing of larger product or decreased if intended to be used with smaller product.

Figure 3:
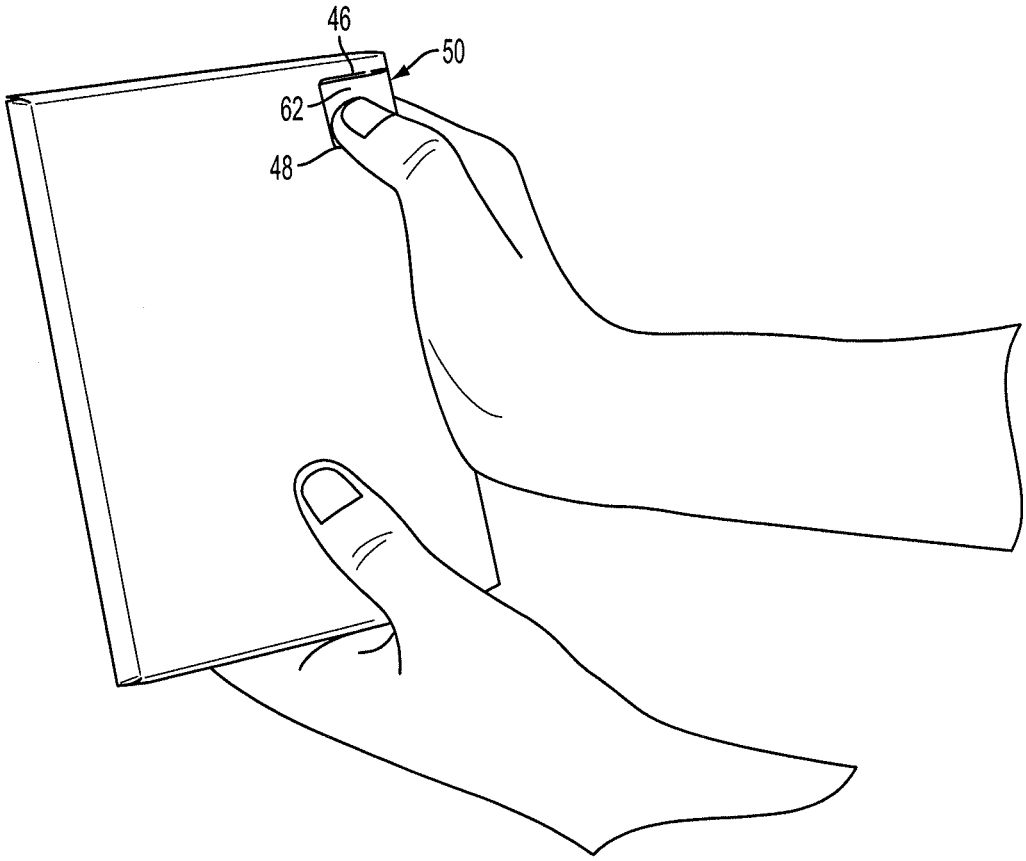
FIG. 3 is a perspective view of the assembled carton of FIG. 2 as a user begins to open the opening and reclosing feature.

FIG. 3 is a perspective view of a carton assembled from the blank of FIG. 1 as a user is pressing against the opening and reclosing feature 50 with sufficient pressure to break perforation lines 46, 48 and release tab 62. FIG. 4 is a perspective view of the carton as tab 62 of opening and reclosing feature 50 moves around fold lines 42, 44 (not shown) from its closed position into its open position. Once moved from its closed position, aperture 60 is exposed, allowing for the dispensing of product from the carton. Aperture 60 includes a front portion 61 and a rear portion 63, with front portion 61 having a height 71 and rear portion 63 having a height 73, where height 71 is greater than height 73 due to the offset discussed above. Although tab 62 is shown in FIG. 4 as moving to its open position toward panel 3, tab 62 could alternatively be pushed toward panel 5.

The offset between the front and rear portions of tab 62 and aperture 60 created by the angling of perforation line 48 (and in other embodiments, perforation line 46 and/or perforation line 48) aids in the retention of tab 62 in its open position. Specifically, the angling results in an aperture 60 that has a height 73 towards rear portion 63 of aperture 60 that is shorter than height 51 of front portion 52 of tab 62. When tab 62 moves to its open position, front portion 52 of tab 62 is wedged into rear portion 63 of aperture 60. Because front portion 52 of tab 62 has a height 51 that is taller than height 73 of rear portion 63 of aperture 60, tab 62 is securely held in this open position via friction. As shown in FIG. 5, once tab 62 is secured by friction in its open position, product 70 housed within the container may be dispensed through aperture 60.

Figure 6:
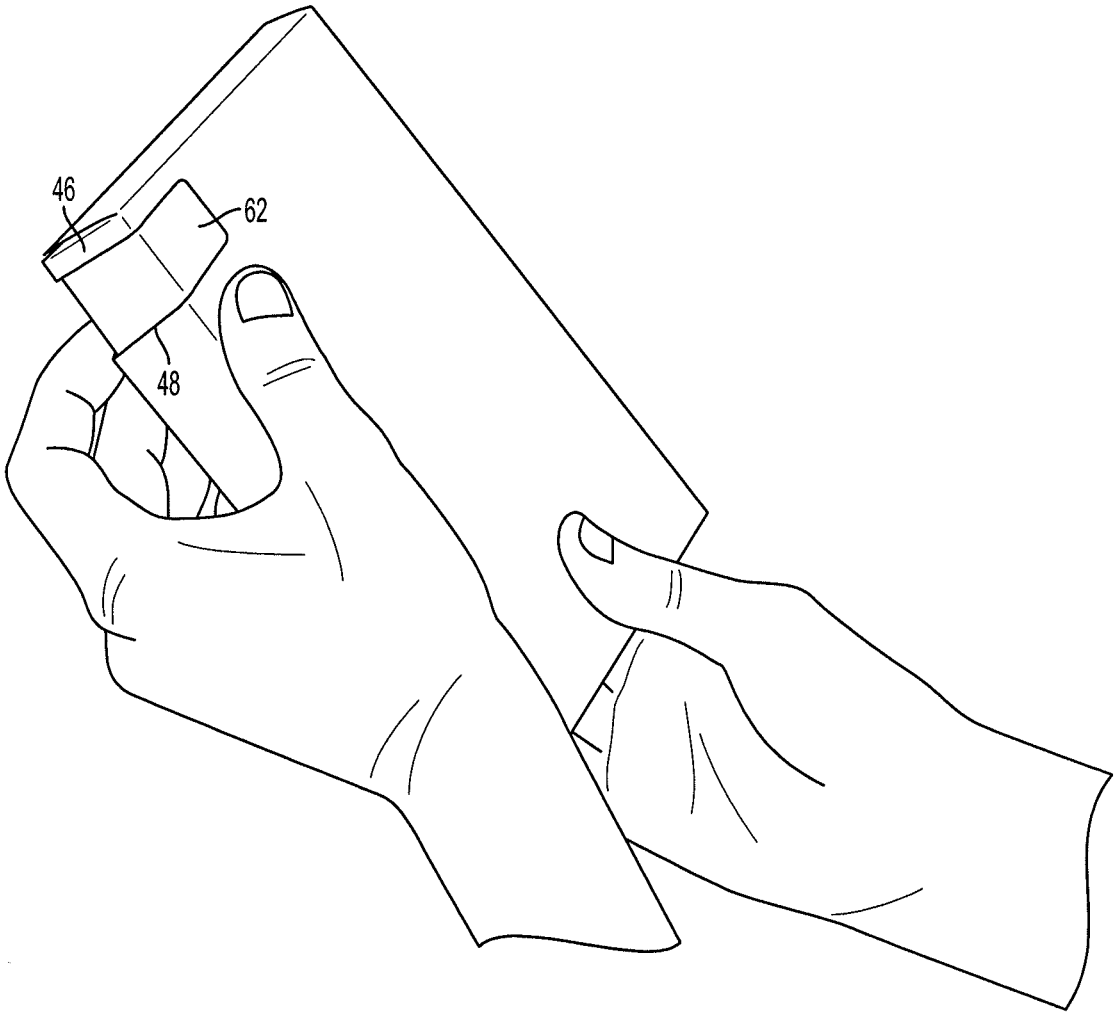
FIG. 6 is a perspective view of the assembled carton of FIG. 2 as the opening and reclosing feature is moved back to its closed position.
Figure 7:
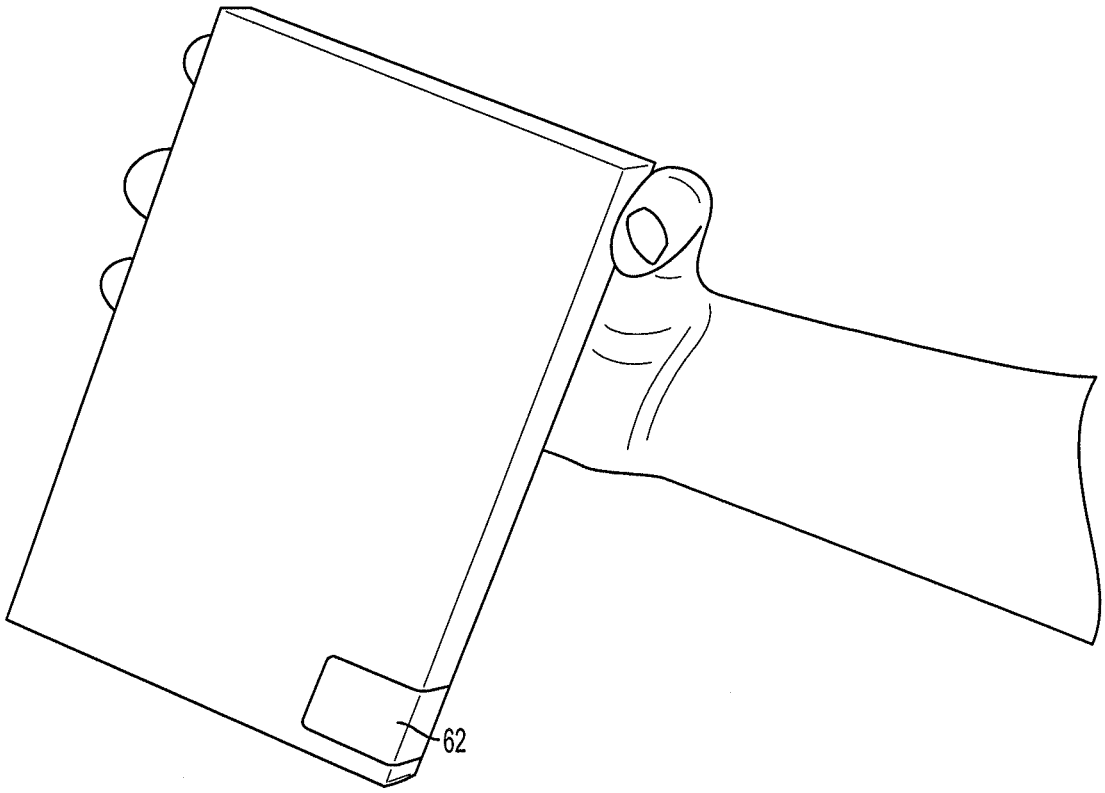
FIG. 7 is a perspective view of the assembled carton of FIG. 2 shown in the closed position.

As shown in FIG. 6, tab 62 may be moved back to its closed position to cover aperture 60 and secure the product within the carton. The friction between tab 62 and the edges of aperture 60 (at perforation lines 46, 48) assists in securing tab 62 in its closed position. As shown in FIG. 7, when tab 62 is moved back into its closed position, aperture 60 is covered and the carton may be turned upside down and even shaken without its contents being dispensed. Tab 62 is configured so it may be moved from its open to its closed position repeatedly. As mentioned above, the degree of the offset between the front and rear portions of tab 62 and aperture 60 (as determined by the angling of perforation line 48 and/or perforation line 46) can be adjusted to vary how easily tab 62 moves from its open position to its closed position and how securely tab 62 is secured in its open position.

The foregoing description of the embodiments, including illustrated embodiments, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed is:

1. A carton formed from a single piece of foldable material comprising:

a front panel disposed between and foldably connected to a pair of side panels;

a back panel opposite the front panel, the back panel disposed between and foldably connected to the pair of side panels;

a top panel opposite a bottom panel; and an opening and reclosing feature that extends across a portion of each of the pair of side panels and that extends across the front panel and that comprises a first height at the front panel that is greater than a second height of the opening and reclosing feature at either of the pair of side panels, wherein the opening and reclosing feature is configured to be opened and closed repeatedly, wherein the opening and reclosing feature comprises a tab having an open position and a closed position, and wherein, when the tab is in the open position, an aperture is exposed providing access to an interior of the carton and a portion of the tab having the first height abuts with a rear portion of the aperture having a third height that is shorter than the first height, creating a friction fit that secures the tab in the open position.

2. The carton of claim 1, wherein the opening and reclosing feature is integral with the carton.

3. The carton of claim 1, wherein the opening and reclosing feature is defined by perforation lines and fold lines.

4. The carton of claim 1, wherein a top of the opening and reclosing feature is created by a first perforation line and wherein a bottom of the opening and reclosing feature is created by a second perforation line.

5. The carton of claim 4, wherein at least one of the first perforation line and the second perforation line is angled to cause the first height to be greater than the second height.

6. The carton of claim 1, further comprising a notch positioned above the opening and reclosing feature.

7. The carton of claim 1, wherein the opening and reclosing feature is a movable section configured to pivot side-to-side about first and second fold lines toward a first of the pair of side panels and toward a second of the pair of side panels.

8. A carton comprising:

a first side panel and a second side panel opposite the first side panel;

a front panel separating the first and second side panels; and an opening and reclosing feature movable between an open position and a closed position, wherein the opening and reclosing feature is formed by perforation and fold lines and extends across the front panel and across a portion of each of the side panels, wherein, when in the open position, the opening and reclosing feature reveals an aperture providing access to an interior of the carton;

wherein, when in the closed position, the opening and reclosing feature covers the aperture and blocks access to an interior of the carton;

wherein the opening and reclosing feature has a first height at a front of the feature along the front panel that is greater than a second height of the feature along either of the two side panels;

wherein the opening and reclosing feature comprises a tab that folds along the fold lines when the opening and reclosing feature is moved to the open position; and wherein, when the opening and reclosing feature is in the open position, top and bottom edges of the front of the opening and reclosing feature abut a rear portion of the aperture, the rear portion of the aperture having a height that is slightly smaller than the first height of the front of the opening and reclosing feature.

9. The carton of claim 8, wherein the opening and reclosing feature is a movable section configured to pivot about the fold lines toward a first of the pair of side panels and toward a second of the pair of side panels.

10. The carton of claim 8, wherein the abutment of the top and bottom edges of the front of the opening and reclosing feature with the rear portion of the aperture creates a friction fit that secures the opening and reclosing feature in the open position.

11. A blank comprising:

a first panel and a second panel of substantially the same dimensions separated from one another by a third panel; and a first perforation line and a second perforation line, wherein a first fold line joins a first end of the first perforation line to a first end of the second perforation line and wherein a second fold line joins a second end of the first perforation line to a second end of the second perforation line, and wherein each of the first perforation line and the second perforation line extends across the third panel and across a portion of the first panel and across a portion of the second panel.

12. The blank of claim 11, wherein a portion of at least one of the first perforation line and the second perforation extends away from a center of that perforation line at a non-zero angle.

13. The blank of claim 11, wherein the first and second perforation lines and the first and second fold lines together form an opening and reclosing feature, wherein a center of the opening and reclosing feature has a height that is greater than a height of the opening and reclosing feature along either the first fold line or the second fold line.

14. The blank of claim 13, further comprising a notch positioned above the center of the opening and reclosing feature.

15. The blank of claim 11, wherein the first perforation line and the second perforation line are not parallel to one another.

16. The blank of claim 11, wherein the first and second perforation lines and the first and second fold lines together form an opening and reclosing feature, wherein a height of the opening and reclosing feature varies along a length of the feature.

* * * * *